US005320495A

United States Patent [19]

Ralph

[11] Patent Number: 5,320,495

[45] Date of Patent: Jun. 14, 1994

[54] PRESSURE SWITCH ADAPTOR FOR WELL SYSTEM

[75] Inventor: Darrel J. Ralph, Chardon, Ohio

[73] Assignee: Essef Corporation, Chardon, Ohio

[21] Appl. No.: 976,574

[22] Filed: Nov. 16, 1992

[51] Int. Cl.[5] ..... F04B 49/08

[52] U.S. Cl. ..... 417/38; 417/44 B; 417/44 H; 285/89

[58] Field of Search ..... 417/38, 44 B, 44 H; 285/92, 93, 89, 357, 354

[56] References Cited

U.S. PATENT DOCUMENTS

| | | | |
|---|---|---|---|
| 3,650,324 | 3/1972 | Randles et al. | 417/36 |
| 3,679,326 | 7/1972 | Weber | 417/44 |
| 3,994,624 | 11/1976 | Plunkett et al. | 417/38 |
| 4,304,526 | 12/1981 | Shetler, Sr. | 417/38 |
| 5,147,530 | 9/1992 | Chandler et al. . | |

*Primary Examiner*—Richard A. Bertsch
*Assistant Examiner*—David W. Scheuermann
*Attorney, Agent, or Firm*—Pearne, Gordon, McCoy & Granger

[57] ABSTRACT

A pressure switch adaptor designed to replace existing pressure switch adapters or connections and pressurizing air valves conventionally associated with water storage and distribution tanks. The adaptor is designed to be used as original equipment on new water tanks or to retrofit existing tanks, replacing the pressurizing air valve conventionally provided by the latter. Whether used on a new tank or retrofitting a used tank, the pressure switch adaptor fits into the port conventionally reserved for the pressurizing air valve. The adaptor provides a pressurizing air valve to allow initial pressurization of the air filled diaphragm and a pressure switch connection for fluid communication between an internal tank diaphragm and the pressure switch, which controls actuation of the tank's water-supplying pump. By placing the pressure switch adaptor on the air side of the system, problems associated with corrosion and corruption of the switch due to prolonged contact with water are eliminated. The pressure switch adaptor improves upon known pressure switch adaptors which require a separate access port, or which are placed on the water side of the system.

4 Claims, 2 Drawing Sheets

PRESSURE SWITCH ADAPTOR FOR WELL SYSTEM

BACKGROUND OF THE INVENTION

1. Field of the Invention

The present invention generally relates to water supply systems and, more particularly, to pressure switch adaptors for such water supply systems.

2. Description of the Related Art

Pressure regulated water supply systems have developed over the years to include a water storage tank which provides an internal, flexible, pressurized air diaphragm. Typically, water is supplied from a well or other source to the tank by means of a pump. Thereafter, the water in the tank, which is pressurized to a predetermined degree by means of the air diaphragm, is distributed and used throughout the system as needed. When the pressure in the system falls as a result of water use, the pump is activated by a pressure-sensitive pump switch, introducing more water into the tank.

In systems of this type, the pressure switch which activates the pump is in communication with the water line leading from the pump to the tank. The pressure switch monitors the system water pressure and turns the pump on when the pressure falls below a predetermined lower level, thereby replenishing the water in the tank and restoring the system water pressure. The pressure switch deactivates the pump when the water pressure in the system has reached a predetermined upper level. Between the upper and lower pressure levels lies the operating range in which the pressurized tank supplies water to the system without activation of the pump.

Pressure switches of this type, although they work satisfactorily when new, tend to become encrusted with minerals or otherwise deteriorate due to their prolonged contact with water. This leads to a serious maintenance problem in existing systems, wherein the operation of the pressure switch is erratic and, eventually, the switch must be replaced. In an effort to solve the problems of encrustation resulting from switch exposure to water, systems have developed which place the pressure switch on the air side of the system rather than the water side.

U.S. Pat. No. 4,304,526, the disclosure of which is incorporated herein by reference, is exemplary of the foregoing systems wherein it discloses an improved well system and flow control tank which includes a pressure switch in communication with the interior of the tank's air diaphragm. The '526 patent has recognized the problems associated with encrustation of pressure gauges and pressure switches, and has attempted to solve those problems by providing a separate conventional diaphragm accessing port for the pressure switch. A separate pressurizing air valve, which has its own diaphragm accessing port, is provided to initially pressurize the diaphragm.

In the '526 patent, two ports are necessary to provide initial pressurization and pressure switch connections for the tank. Although this results in improved performance when compared to one port tanks which employ pressure switches on the water side of the system, it also leads to an increase in tank manufacturing costs over such one-port tanks. Also, by increasing the number of external ports, the likelihood that a tank leak will develop is correspondingly increased. Such an arrangement cannot be employed on existing one-port tanks due to the necessary addition of a separate port.

Therefore, there exists a need in the art for a combined pressure switch connection and pressurizing air valve which can be mounted to the tank via a single diaphragm accessing port. Furthermore, there exists a need in the art for such a combined pressure switch connection and pressurizing air valve which can be used to replace the pressurizing air valves and pressure switch connections in existing tanks to upgrade the overall system performance.

SUMMARY OF THE INVENTION

The present invention is generally directed towards a pressure switch adaptor for a well water system. The pressure switch adaptor in accordance with the present invention is adapted to provide fluid communication between the air side of the system and a pressure sensitive pump switch and pressurizing air valve. The pressure switch adaptor mounts to a water storage and distribution tank in a location traditionally reserved for a conventional pressurizing air valve.

The pressure switch adaptor of the present invention eliminates contact of the pressure switch with water, and the corresponding corrosion and encrustation problems common in pressure switch connections which are located in the water supply line.

The present invention is further directed towards a pressure switch adaptor which is designed to retrofit existing tanks by installing into the port currently used by the conventional pressurizing air valve. By removing the existing pressure switch connection, which is in the water supply line, and the pressurizing air valve, and installing the combined valve and switch connection at the port previously used by the pressurizing air valve, erratic operation of the pressure switch due to encrustation of mineral deposits and the like thereon is eliminated.

The pressure switch adaptor combines a pressurizing air valve and a pressure sensitive pump switch connection, allowing pressure sensing and precharging to be accomplished via a single diaphragm accessing port, minimizing manufacturing costs while improving long-term pressure switch performance. With the pressure switch connection on the air side of the system, consistent and long-lived operation of the pressure switch, as compared to when placed on the water side of the system, is assured. Also, limiting the number of diaphragm accessing ports minimizes tank manufacturing costs, and reduces the likelihood that the tank will leak.

BRIEF DESCRIPTION OF THE DRAWINGS

These and further features of the invention will be apparent with reference to the following description and drawings, wherein.

DETAILED DESCRIPTION OF THE PREFERRED EMBODIMENT

Figure 1:
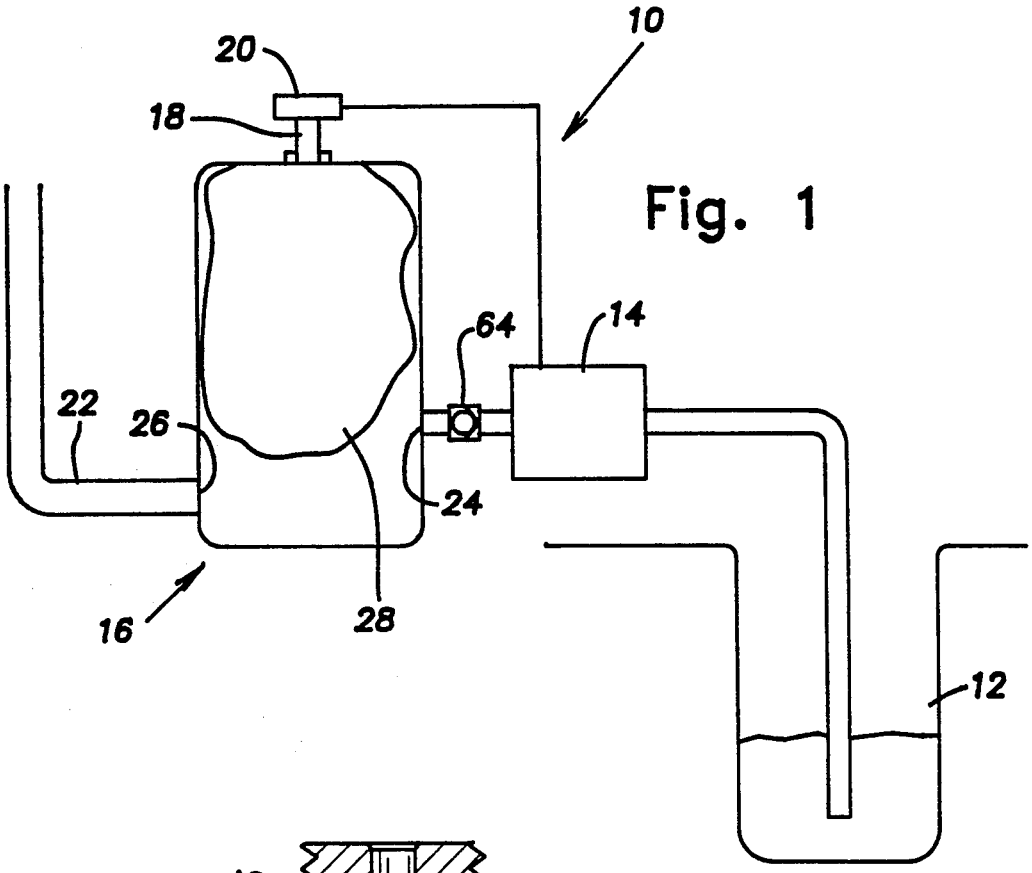
FIG. 1 shows a well system in accordance with the present invention.

With reference to FIG. 1, the well system 10 according to the present invention is schematically shown to include a well 12, a pump 14, a water storage and distribution tank 16, a pressure switch adaptor 18, a pressure sensitive pump switch 20 and a water distribution network 22.

The water storage and distribution tank 16 generally includes water inlet and outlet ports 24, 26, and a flexible diaphragm 28. The flexible diaphragm 28 is provided with an air stem 30. In accordance with the present invention, the air stem 30 is exteriorly threaded to allow the pressure switch adaptor 18 to mount thereto, as will be described more fully hereafter.

Figure 2:
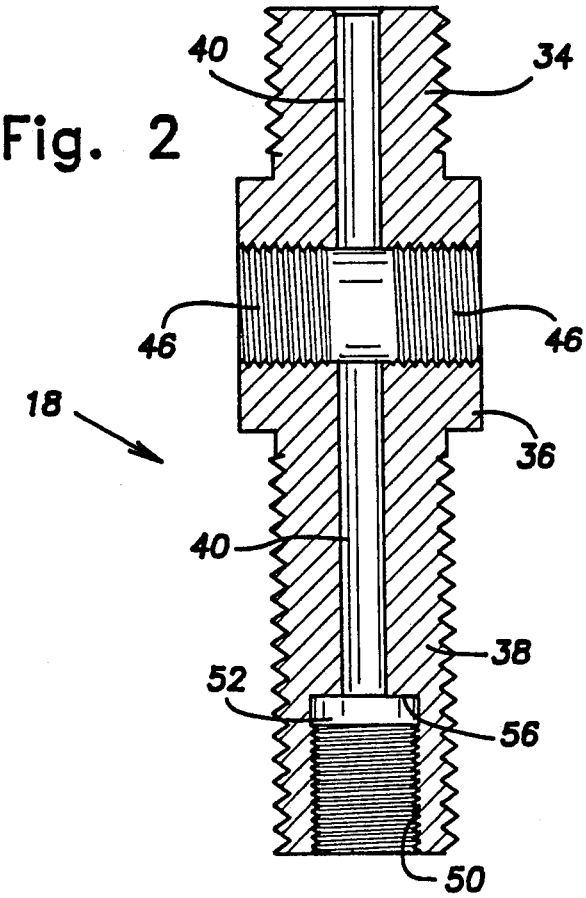
FIG. 2 is a front cross-sectional view of the pressure switch adaptor in accordance with the present invention.

As shown best in FIG. 2, the pressure switch adaptor 18 includes an upper section 34, a central section 36, a lower section 38, and a longitudinal bore 40. The upper section 34 is externally threaded to facilitate the threaded attachment of the pressure switch 20 thereto. The longitudinal bore 40 extends through the upper, central and lower sections to provide fluid communication between the interior of the flexible diaphragm 28 and a pressurizing air valve 42, an air pressure gauge 44 and the pressure switch 20 (FIG. 3).

The central section 36 includes a transverse hole 46, respective ends of which are threaded to receive the pressurizing air valve 42 and the air pressure gauge 44.

The lower section 38 of the pressure switch adaptor 18 is externally threaded to receive a support disk 48 which helps retain the pressure switch adaptor 18 on the air stem 30, as will be described hereafter. A threaded counterbore 50 is provided by the lower end to receive the air stem 30. The counterbore 50 is coaxial with the longitudinal bore 40, an inner end 52 of the counterbore being adapted to receive an O-ring 54. When the pressure switch adaptor 18 is threadably mounted on the air stem 30, the O-ring 54 is trapped between an inner annular surface 56 and the air stem 30 to seal the connection therebetween.

Figure 3:
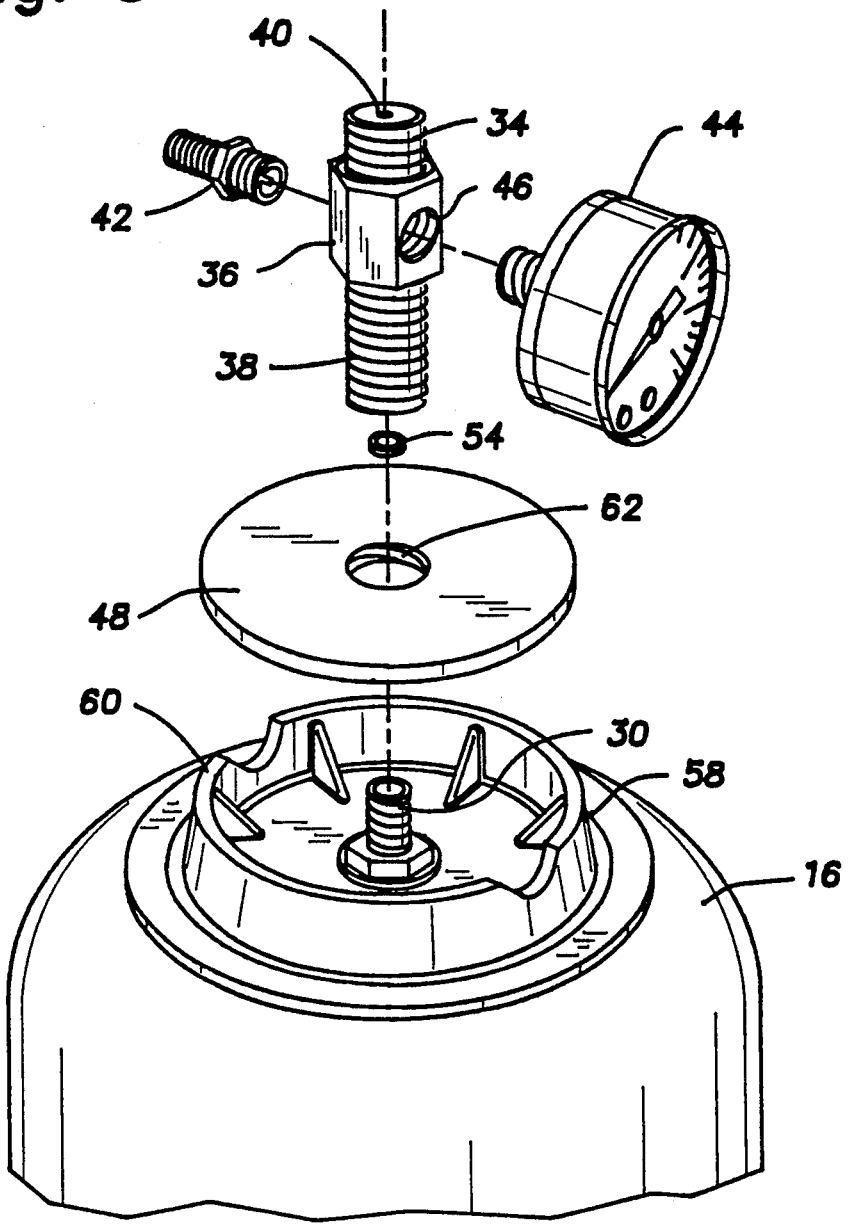
FIG. 3 is an exploded perspective view of the tank and pressure switch adaptor in accordance with the present invention.

As shown best in FIG. 3, the tank 16 provides an upwardly extending rim 58 which surrounds the air stem 30. The rim 58 includes an upper surface 60 which is adapted to engage the support disk 48. The support disk includes a threaded central aperture 62 which engages the externally threaded surface provided by the lower section 38 of the pressure switch adaptor, as discussed previously.

Installation of the pressure switch adaptor 18 in new tanks or retrofitting the pressure switch adaptor into existing systems is generally identical except that the existing systems require the initial removal of the existing air valve and pressure switch connector.

Therefore, on existing tanks the existing air valve core, which functions in the same manner as the pressurizing air valve of the present invention, is removed by unscrewing it from the air stem. The pressure switch connection, which is typically installed in the water line between the pump and the tank is simply taken out and replaced by a section of pipe. With the existing system so modified, installation of the pressure switch adaptor therein is identical to its installation in new tanks, which will be described hereafter with reference to the foregoing description and drawings. The lower section 38 of the pressure switch adaptor 18 is preliminarily assembled by inserting the O-ring 54 into the counterbore 50 and threadably mounting the support disk 48 on the lower section. The support disk 48 is advanced to the top of the lower section 38 to allow mounting of the pressure switch adaptor 18 on the air stem 30. The pressurizing air valve 42 and the air pressure gauge 44 are threadably inserted into respective ends of the transverse hole 46 provided in the central section 36.

After being preliminarily assembled, the pressure switch adaptor 18 is threaded onto the air stem 30 via the threaded counterbore 50 in the lower section 38 until the air stem sealingly engages the O-ring 54 received within the counterbore 50. The support disk 48 is rotated, advancing it downward until it contacts the upper surface 60 of the rim 58. Hand tightening of the disk 48 locks the adaptor 18 in place.

Thereafter, the pressure sensitive pump switch 20 can be screwed onto the upper section 34 of the pressure switch adaptor. At this point the system is assembled and ready to be charged before operation can commence. The system is charged to a predetermined pressure by introducing air through the pressurizing air valve 42. Thereafter, the pressurizing air valve is closed and further air is not introduced into the diaphragm, system pressure being kept within the desired operating range by operation of the pump 14, as will be clear from the following discussion.

As water is used throughout the system 22, it is withdrawn from the tank 16 and the system pressure begins to fall. When the system pressure reaches a predetermined lower level, the pressure switch 20, which is in communication with the interior of the diaphragm 28 via the pressure switch adaptor 18, activates the pump 14. The pump thereafter draws more water out of the well 12 and pumps it into the tank 16. Naturally, a check valve 64 or the like is provided between the pump 14 and the tank 16 to prevent water from flowing back into the well 12 from the system 22. There exist several known methods for preventing water from draining back into the well while keeping the pump properly primed, each of which is capable of being used with the present invention.

As water is pumped into the tank 16, the system pressure increases, eventually reaching a predetermined upper level at which point the pressure sensitive switch 20 turns the pump 14 off. As water is used in the system, the pressure falls, but the pump 14 is not activated by the pressure sensitive pump switch 20 so long as the system pressure is above the predetermined lower level.

In the system thus described, the pressure switch adaptor 18, and the pressure switch 20 itself, do not come in contact with the well water and therefore do not suffer from the deleterious effects resulting from prolonged contact with water. The pressure switch adaptor 18 of the present invention combines the pressurizing air valve 42, the air pressure gauge 44, and a pressure switch connection into an economical and practical package, removing many of the disadvantages known in the art. For instance, only a single diaphragm accessing port is required to perform the initial pressurization, pressure sensing and monitoring functions provided by the present invention. Moreover, the pressure switch adaptor can be used on new and old tanks alike, and is especially adapted for easy on-site installation on existing tanks.

The foregoing description of the invention is illustrative of the preferred embodiment of the invention currently contemplated by the inventor thereof. However, it should be clear that the foregoing description of the invention is not to be interpreted in a limitative manner, there being several equivalent systems and manners of performing the present invention. For example, the pressure sensitive pump switch 20 can be attached to the pressure switch adaptor 18 in several equivalent manners. Also, the air pressure gauge is not necessary for proper operation of the present invention and can be replaced by a plug without departing from the scope and spirit of the present invention. Hence, the true scope of the invention is only to be defined by the claims appended hereto.

What is claimed is:

1. A fluid system pressure switch adaptor which is adapted to provide fluid communication between a pressure sensitive pump switch and an interior of a pressure vessel, comprising:

pressure switch adaptor means defining fluid pressure passage means;

coupling means adapted to couple said passage means of said pressure switch adaptor means to the interior of said pressure vessel;

a pressurizing air valve, said pressurizing air valve being connected to said adaptor means and being in fluid communication with sad passage means for controlling fluid communication between the interior of said vessel and the atmosphere, said pressurizing air valve being operable to allow pressurization of sad vessel to a predetermined level;

a pressure switch connected to said pressure switch adaptor means and being in fluid communication with said fluid pressure passage means and the interior of said pressure vessel, whereby the pump switch activates a pump when fluid pressure in the system reaches a predetermined lower level and deactivates said pump when fluid pressure in the system reaches a predetermined upper level.

2. A pressure switch adaptor according to claim 1, wherein said coupling means comprises a threaded body of said pressure adaptor, said threaded body being threadably mounted onto an air stem extending from said pressure vessel to coupled said adaptor to said pressure vessel.

3. A pressure switch adaptor according to claim 2, wherein said coupling means further comprises a support disk, said support disk engaging a rim which extends upwardly from said pressure vessel and generally surrounds said air stem, said disk being threadably mounted on said threaded body and being operably to hold said threaded body on said air stem.

4. A water storage and distribution tank for a water system, said tank including a flexible diaphragm for pressurizing the system and having mounted thereto a fluid system pressure switch adaptor, said adaptor being in communication with an interior of said diaphragm and comprising:

a pressurizing air valve connected to said adaptor which controls fluid communication between the interior of said diaphragm and a pressure source;

a pressure switch connection in said adaptor, said pressure switch connection fluidly coupling a pressure sensitive pump switch and the interior of said diaphragm, a pump electrically connected to said pump switch, whereby said pump switch activates said pump when fluid pressure in the system reaches a predetermined lower level and deactivates the pump when fluid pressure reaches a predetermined upper level.

* * * * *

UNITED STATES PATENT AND TRADEMARK OFFICE

CERTIFICATE OF CORRECTION

PATENT NO. : 5,320,495

DATED : June 14, 1994

INVENTOR(S) : Darrel J. Ralph

It is certified that error appears in the above-identified patent and that said Letters Patent is hereby corrected as shown below:

Column 5, line 19, "sad" should read --said--;
Column 5, line 23, "sad" should read --said--;

Column 6, line 5, "coupled" should read --couple--;
Column 6, line 12, "operably" should read --operable--.

Signed and Sealed this

First Day of November, 1994

*Attest:*

*Attesting Officer*

Bruce Lehman

BRUCE LEHMAN

*Commissioner of Patents and Trademarks*